US008136907B2

(12) United States Patent
Eun et al.

(10) Patent No.: US 8,136,907 B2
(45) **Date of Patent: *Mar. 20, 2012**

(54) SYSTEM AND METHOD FOR COMPENSATING FOR REGISTRATION ERRORS ARISING FROM HEATED ROLLERS IN A MOVING WEB PRINTING SYSTEM

(75) Inventors: Yongsoon Eun, Webster, NY (US); Jeffrey J. Folkins, Rochester, NY (US); Jess R. Gentner, Rochester, NY (US); Todd W. Thayer, Rochester, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 358 days.

This patent is subject to a terminal disclaimer.

(21) Appl. No.: 12/562,015

(22) Filed: Sep. 17, 2009

(65) Prior Publication Data

US 2011/0063357 A1 Mar. 17, 2011

(51) Int. Cl.
*B41J 29/38* (2006.01)

(52) U.S. Cl. ..... 347/17

(58) Field of Classification Search ..... 347/14, 347/16, 19, 37, 101, 104
See application file for complete search history.

(56) References Cited

U.S. PATENT DOCUMENTS

| | | | | |
|---|---|---|---|---|
| 4,990,767 | A | 2/1991 | Ernst et al. | |
| 5,455,668 | A | 10/1995 | De Bock et al. | |
| 5,499,093 | A | 3/1996 | Aerens et al. | |
| 5,600,352 | A | 2/1997 | Knierim et al. | |
| 5,828,937 | A | 10/1998 | Aerens et al. | |
| 6,076,922 | A | 6/2000 | Knierim et al. | |
| 6,215,119 | B1 | 4/2001 | Markham et al. | |
| 6,330,424 | B1 | 12/2001 | Chapman et al. | |
| 6,374,076 | B1 * | 4/2002 | Tanaka | 399/396 |
| 6,407,678 | B1 | 6/2002 | Elgee et al. | |
| 7,245,862 | B2 | 7/2007 | Ebara | |
| 7,467,838 | B2 | 12/2008 | Folkins et al. | |
| 7,583,920 | B2 | 9/2009 | Willemsens et al. | |
| 7,587,157 | B2 * | 9/2009 | Matsuda et al. | 399/301 |
| 2003/0210932 | A1 | 11/2003 | Koide et al. | |
| 2008/0088661 | A1 | 4/2008 | Folkins et al. | |

* cited by examiner

*Primary Examiner* — An Do
(74) *Attorney, Agent, or Firm* — Maginot, Moore & Beck, LLP

(57) ABSTRACT

A method compensates for thermal expansion of rollers in a web print zone. The method includes receiving an angular velocity signal from a first encoder for a roller in a print zone of a moving web printing system, receiving a signal from a first temperature sensor corresponding to a temperature of the roller, modifying a first diameter for the first roller with a first predetermined distance in response to the temperature of the first roller being different than a first predetermined temperature, identifying a velocity of a moving web in the print zone of the moving web printing system with reference to the modified first diameter, and delivering a firing signal to a first printhead proximate the first roller to energize the inkjet nozzles in the first printhead and eject ink onto the web at a position corresponding to the identified moving web velocity.

17 Claims, 4 Drawing Sheets

SYSTEM AND METHOD FOR COMPENSATING FOR REGISTRATION ERRORS ARISING FROM HEATED ROLLERS IN A MOVING WEB PRINTING SYSTEM

TECHNICAL FIELD

This disclosure relates generally to web printing systems, and more particularly, to web printing systems that use a series of printheads in a print zone to form images on the web.

BACKGROUND

A known system for ejecting ink to form images on a moving web of media material is shown in FIG. 3. The system 10 includes a web unwinding unit 14, a web cleaner 18, a pre-heater roller 22, a plurality of marking stations 26, a turn roller 30, a temperature leveling roller 34, and a spreader 38. In brief, the web unwinding unit 14 includes an actuator, such as an electrical motor, that rotates a web of media material in a direction that removes media material from the web. The media material is fed through the web cleaner 18 along a path formed by the pre-heater roller 22, turn roller 30, and leveling roller 34 and then through the spreader 38 to a rewinder 40. The web cleaner 18 removes debris and loose particulate matter from the web surface to be printed and the pre-heater roller 22 is heated to a temperature that transfers sufficient heat to the media material for optimal ink reception on the web surface as it passes the marking stations 26. Each of the marking stations 26A, 26B, 26C, and 26D in FIG. 3 includes two staggered full width printhead arrays, each of which has three or more printheads that eject ink onto the web surface. The different marking stations eject different colored inks onto the web to form a composite colored image. In one system, the marking stations eject cyan, magenta, yellow, and black inks for forming composite colored images. The surface of the web receiving ink does not encounter a roller until it contacts the temperature leveling roller 34. The temperature leveling roller 34 modifies the temperature of the web for both any inked and non-inked portions and reduces any temperature differences between them. After the temperature leveling, the ink is heated by heater 44 before the printed web enters the spreader 38. The spreader 38 applies pressure to the ejected ink on the surface of the web to smooth the roughly semicircular ink drops on the surface of the web and to encourage ink fill with the different colors and present a more uniform image to a viewer. The web material is then rewound by the rewinder 40 for movement to another system for further processing of the printed web.

This system 10 also includes two load cells, one of which is mounted at a position near pre-heater roller 22 and the other is mounted at a position near the turn roller 30. These load cells are devices that measure the tension on the web monitored by the load cell. Each of the rollers 22, 30, and 34 has an encoder mounted on the roller. These encoders may be mechanical or electronic devices that measure the angular velocity of a roller monitored by the encoder. In a known manner, the angular velocity measured by an encoder may be converted to a linear measurement of the web velocity moving over the roller. The angular velocity signals generated by the encoders and the tension measurement signals generated by the two load cells are coupled to a controller 60. The controller 60 is configured with I/O circuitry, memory, programmed instructions, and other electronic components to implement a web printing system that generates the firing signals for the printheads in the marking stations 26. The term "controller" or "processor" as used in this document refers to a combination of electronic circuitry and software that generates electrical signals that control a portion or all of a process or system. The controller 60 may implement either a single reflex or a double reflex registration system to time the delivery of firing signals to printheads in a print zone of a web printing system. "Double reflex registration system" refers to a system that uses the angular velocity signals corresponding to the rotation of two rollers to compute the web velocity at a printhead positioned between the two rollers. A single reflex registration system refers to a system that uses the angular velocity signals corresponding to the rotation of only one roller to compute a linear web velocity that is used to predict web positions and timing in a print zone.

The system 10 may also include an image-on-web array (IOWA) sensor 68 that generates an image signal of a portion of the web as it passes the IOWA sensor. The IOWA sensor 68 may be implemented with a plurality of optical detectors that are arranged in a single or multiple row array that extends across at least a portion of the web to be printed. The detectors generate signals having an intensity corresponding to a light reflected off the web. The light is generated by a light source that is incorporated in the IOWA sensor and directed toward the web surface to illuminate the surface as it passes the optical detectors of the IOWA sensor. The intensity of the reflected light is dependent upon the amount of light absorbed by the ink on the surface, the light scattered by the web structure, and the light reflected by the ink and web surface. The image signal generated by the IOWA sensor is processed by an integrated registration color controller (IRCC) to detect the presence and position of ink drops ejected onto the surface of the web at the IOWA sensor. Any suitable optical sensor or sensors that can be configured to generate image data for a portion of a moving web and any ink on the web may be used to generate image data for registration analysis.

As noted above, the controller 60 uses the angular velocity measurements from the encoders at the rollers and may also use tension measurements from the two load cells to compute web velocities at the rollers 22, 30, and 34. These velocities enable the controller to determine when a web portion printed by one marking station, station 26A, for example, is opposite another marking station, station 26B, for example, so the second marking station can be operated by the controller 60 with firing signals to eject ink of a different color onto the web in proper registration with the ink already placed on the web by a previous marking station. When the subsequent marking station is operated too soon or too late, the ejected ink lands on the web at positions that may produce visual noise in the image. This effect is known as misregistration. Accurate measurements, therefore, are important in registration of different colored images on the web to produce images with little or no visual noise.

Accurate angular velocity measurements are important for determining the linear velocity of the web at a particular position and the timing of the firing signals correlated to the linear web velocity. In previously known image registration systems, a constant diameter is used for each roller that is monitored by an encoder to generate an angular velocity signal, which is used to compute a linear web velocity. Assuming that the diameter of a roller remains constant may lead to inaccuracies in web velocity calculations. The inaccuracy may be particularly troublesome in heated rollers. These rollers include a heating element that is mounted within the roller or proximate the roller to heat the roller to a temperature above the ambient temperature of the environment of the roller. The heated roller may be used for such purposes as preconditioning the web for printing or the like.

When the roller is heated, the material forming the rotating cylinder of the roller expands. This expansion is particularly apparent in rollers having cylinders formed from metal, such as aluminum or stainless steel. The changes in the diameter of the roller cylinder may be significant enough to affect the accuracy of the velocity computed for the web and the timing of the firing signals for the printheads that eject ink as the web passes by the printheads.

SUMMARY

A method has been developed that compensates for diameter changes in rollers in a print zone of a web printing system. The method includes receiving a signal from a first encoder corresponding to an angular velocity of a first roller in a print zone of a moving web printing system, receiving a signal from a first temperature sensor corresponding to a temperature of the first roller in the print zone of the moving web printing system, modifying a first diameter for the first roller with a first predetermined distance in response to the temperature of the first roller being different than a first predetermined temperature, identifying a velocity of a moving web in the print zone of the moving web printing system with reference to the modified first diameter, and delivering a firing signal to a first printhead proximate the first roller to energize the inkjet nozzles in the first printhead and eject ink onto the web at a position corresponding to the identified moving web velocity.

A system has been developed that enables a controller of a web printing system to compensate for changes in the diameters of rollers in a print zone. The system includes a first roller configured to rotate with a web moving through a print zone of a web printing system, a first encoder mounted proximate the first roller to generate a signal corresponding to an angular velocity of the first roller, a first temperature sensor mounted proximate the first roller to generate a signal corresponding to a temperature of the first roller, a first printhead positioned in the print zone proximate the web, and a controller coupled to the first encoder, the first temperature sensor, and the first printhead, the controller being configured to identify a distance change in a first diameter of the first roller and to compute a web velocity for the web moving through the print zone with reference to the distance change in the first diameter of the first roller, and the controller also being configured to generate a firing signal to the printhead to eject ink onto the web at a position corresponding to the computed web velocity.

A method for computing a thermal coefficient of expansion for a roller in a print zone of a web printing system has been developed. The method includes printing a predetermined pattern onto a first portion of a moving web with a first printhead as the web moves through a print zone of a web printing system while a temperature of a first roller in the print zone is at a first temperature, generating image data corresponding to the printed predetermined pattern after the first portion of the moving web exits the print zone, printing the predetermined pattern onto a second portion of the moving web with the first printhead as the web moves through the print zone of the web printing system while a temperature of the first roller in the print zone is at a second temperature, generating image data corresponding to the printed predetermined pattern after the second portion of the moving web exits the print zone, and identifying a coefficient of thermal expansion from (1) a first diameter for the first roller, (2) a displacement between the predetermined pattern on the first portion of the web and the predetermined pattern on the second portion of the web, and (3) a temperature difference between the first temperature and the second temperature.

BRIEF DESCRIPTION OF THE DRAWINGS

The foregoing aspects and other features of a system and a method that compensate for changes in the diameters of rollers in a print zone that affect web velocity calculations are explained in the following description, taken in connection with the accompanying drawings.

DETAILED DESCRIPTION

Figure 1:
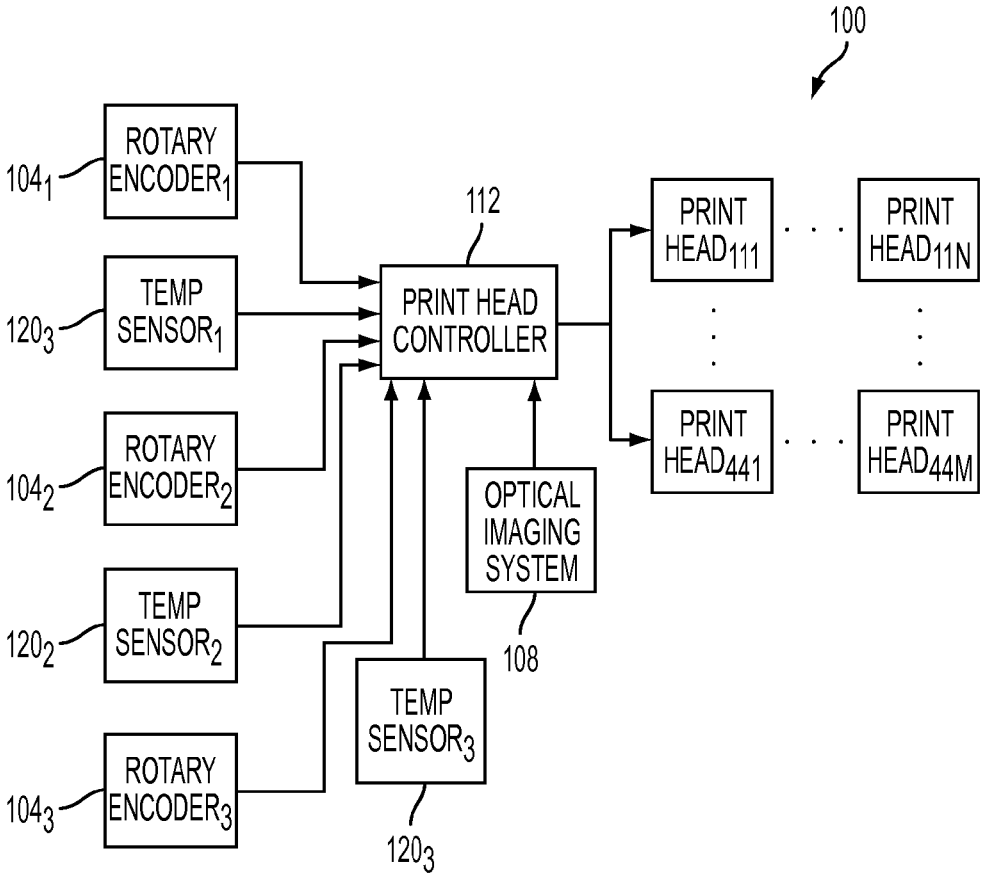
FIG. 1 is a block diagram of a web printing system that enables a controller to identify diameter changes for rollers in a print zone of the web printing system.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system for operating a printer that forms images on a moving web driven by rollers. The reader should also appreciate that the principles set forth in this description may be applicable to imaging systems that form images on sheets.

In one embodiment of a web printing system, the marking stations are solid ink marking stations. Solid ink marking stations use ink that is delivered in solid form to the printer, transported to a melting device where the ink is heated to a melting temperature and converted to liquid ink. The liquid ink is supplied to the printheads in the marking stations and ejected from the printheads onto the moving web in response to firing signals generated by the controller 60. In such a continuous feed direct marking system, the print zone is the portion of the web extending from the first marking station to the last marking station.

As noted above, errors to the angular velocity signals may be introduced by changes in the diameter of a roller caused by thermal expansion of the roller. To address these sources of web speed and position error, a method and system have been developed that uses a coefficient of thermal expansion for a roller to compute a distance change in a diameter of the roller. Thereafter, the coefficient of thermal expansion and a temperature differential that is measured with reference to the baseline temperature at which the coefficient of thermal expansion was measured are used to identify diameter variations in a roller. These diameter variations are used to modify the roller diameter values used to compute web velocity and position error.

Figure 3:
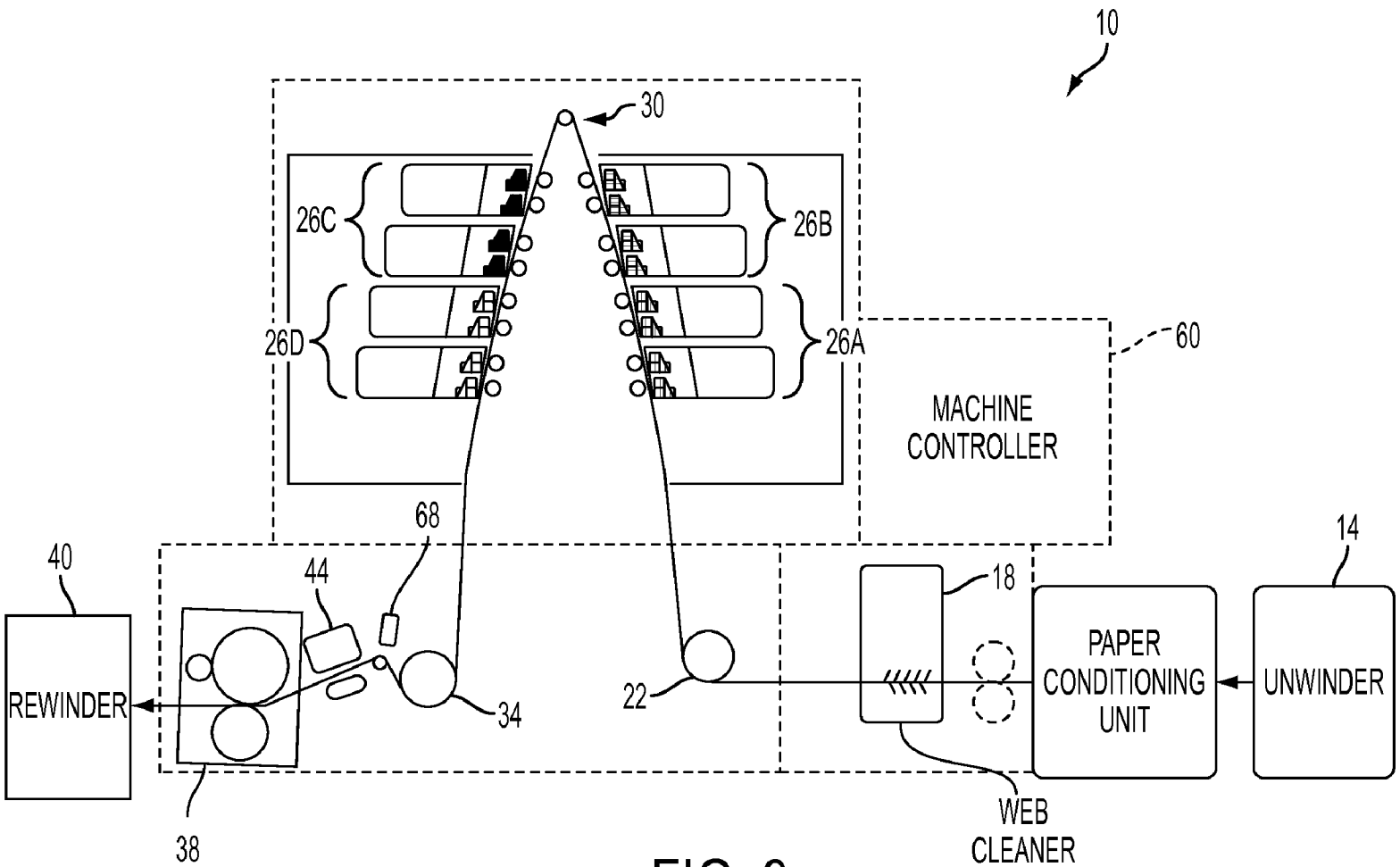
FIG. 3 is a block diagram of a web printing system.
Figure 4:
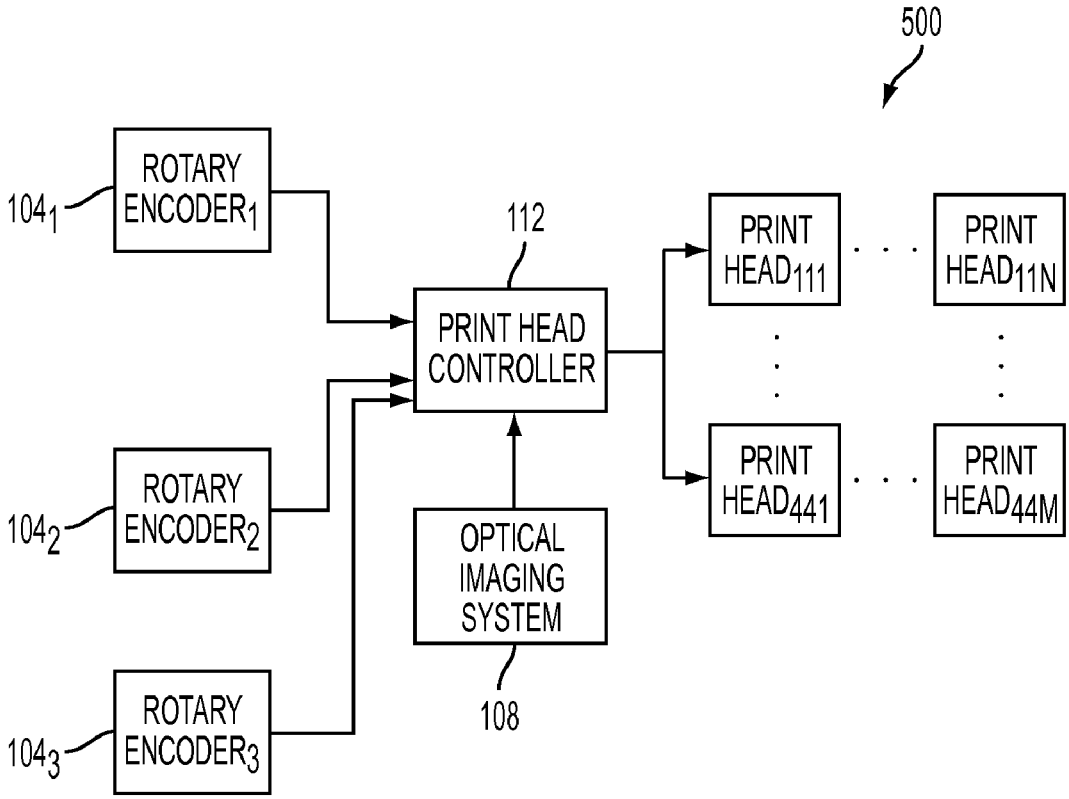
FIG. 4 PRIOR ART
FIG. 4 is a block diagram of a system that calculates web velocity using a double reflex registration process.

A double reflex registration process may be implemented in a known web printing system 500 shown in FIG. 4. In system 500, a printhead controller 112 receives angular velocity measurements for rollers 22, 30, and 34 (FIG. 3) from rotary encoders $\mathbf{104}_1$, $\mathbf{104}_2$, and $\mathbf{104}_3$, respectively. These measurements are used by the controller 112 to identify positions for web portions in the print zone to time the generation and delivery of firing signals to the printheads in the print zone. A double reflex registration process interpolates web velocity at positions between rollers using the web velocities computed for the web at each roller.

Each marking station 26A, 26B, 26C, and 26D (FIG. 3) includes four rows of printheads arranged in a known staggered manner to cover the width of the web. In the notation of FIG. 4, the first printhead of the first marking station is $\text{Printhead}_{111}$ and the last printhead in the first row is $\text{Printhead}_{11N}$, where the first digit is the number of marking station, the second digit is the row in the marking station, and the last digit N is the number of printheads in the row. Thus, the first printhead in the last row of the last marking station in the print zone is $\text{Printhead}_{441}$ and the last printhead in the last row of the last marking station in the print zone is $\text{Printhead}_{44M}$. In one embodiment, N=3 and M=2.

The system 500 may also include an optical imaging system 108. The optical imaging system may reside within the system 400 as the IOWA array 68 does in system 10 of FIG. 3 or it may be a scanner or the like that is external of the system. The optical imaging system images a predetermined pattern of ejected ink from each or some of the printheads on portions of the web after the portions exit the print zone. Comparing the ink on the web generated by each of the printheads enables measurement of relative displacements between where each printhead's predetermined pattern is expected to be on a web portion and where it actually is located. In previously known systems, these displacements were used to adjust the timing of printhead firing signals to cause the printheads to eject ink either sooner or later to compensate for errors in web position calculations.

In the new system 100 shown in FIG. 1, temperature sensors $\mathbf{120}_1$, $\mathbf{120}_2$, and $\mathbf{120}_3$ are mounted in proximity to rollers 22, 30, and 34. These sensors are coupled to the controller 112 to provide signals to the controller that correspond to a temperature of the roller mounted proximate the sensor. Thus, the controller 112 is able to detect the temperature of a roller in the print zone from the signals received from the temperature sensor mounted proximate the roller. In the web velocity measurement process, web velocity may be identified by the equation: $V_{web}=\omega_{roller}\times\pi(d+th_{paper})$, where $V_{web}$ is the web velocity, $\omega_{roller}$ is the angular velocity of a roller obtained from a rotary encoder, d is the diameter of the roller, and $th_{paper}$ is the effective thickness of the web. In a controller that uses a single reflex registration process to compute web velocity and position for the timing of printhead firing, the diameter of only one roller is used for the computation. The roller diameter used may be the diameter of any of the rollers located in the print zone of the printing system. In a controller that uses a double reflex registration process to compute web velocity and position for the timing of printhead firing, the diameters of any two rollers are used for the computation. The two roller diameters used may be the diameters of any two of the rollers located in the print zone of the printing system. If the diameter of the roller is treated as a constant, errors are introduced in the web velocity and position calculations as the actual diameter of the roller or rollers used in the registration process changes in response to a temperature change in the roller. In order to address the diameter changes introduced by temperature variations, a coefficient of thermal expansion is identified for each roller.

Figure 2:
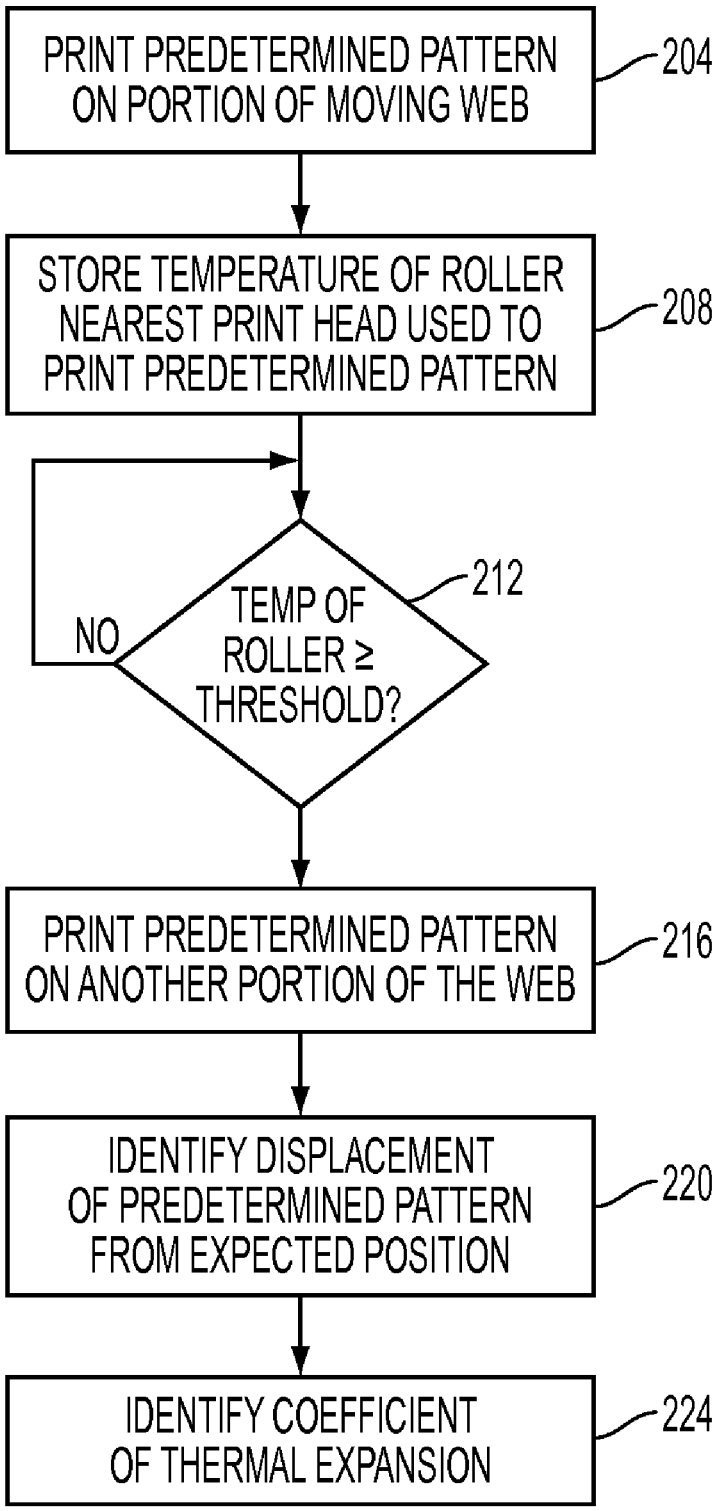
FIG. 2 is a flow diagram of a process that may be implemented to identify a coefficient of thermal expansion for rollers in the print zone of the web printing system.

The process for identifying the coefficient of thermal expansion for a roller is shown in FIG. 2. This coefficient is determined empirically by printing a predetermined pattern on a first portion of the web with a printhead in the print zone (block 204). The predetermined pattern may be a series of ejected ink drops by each ink jet in a printhead to generate a series of vertical lines. The temperature of the roller is detected from the signal generated by the temperature sensor proximate the roller closest to the printhead that printed the predetermined pattern (block 208). The predetermined pattern may be captured by an optical sensor that generates an image signal of a portion of the web on which the pattern was printed as it passes the optical sensor. In one embodiment, the optical sensor is implemented with an IOWA sensor 68, such as the one described above. Alternatively, the test image may be scanned by an offline scanner and the resulting image data may be transmitted to the printer or other image processing system for further analysis. This analysis establishes a baseline diameter for the roller at the first temperature. After the roller reaches a second temperature that differs from the first temperature by some threshold amount (block 212), the predetermined pattern is printed by the same printhead on a second portion of the web (block 216). The second temperature may be greater than or less than the first temperature. An expected position of the printed predetermined pattern is computed with reference to the diameter of the roller used at the first temperature. A displacement of the predetermined pattern on the second portion of the web from the expected position is identified (block 220). The displacement, the baseline diameter, and the difference between the first temperature and the second temperature are used to identify a coefficient of thermal expansion for the roller (block 220).

The coefficient of thermal expansion may be identified with reference to the equation: $d=d_0(c(T-T_0)+1)$, where $d_0$ is the diameter of the roller at temperature $T_0$, $T_0$ is the first temperature, T is the second temperature, d is the increased diameter, and c is the coefficient of thermal expansion. This equation may be rewritten to the form: $c=d-d_0/(d_0(T-T_0))$. With reference to the process described above, $d-d_0$ corresponds to the displacement in the predetermined pattern, $d_0$ is the baseline diameter, and $(T-T_0)$ is the difference between the two temperatures. Once the coefficient of thermal expansion is identified, it should remain relatively constant in the range of temperatures experienced in the print zone of web printing systems. Configuring controller 112 to use this empirically derived coefficient of thermal expansion enables the controller to identify a change in diameter with the equation describing the diameter d noted above. This diameter that corresponds to a current temperature may be used to compute the web velocity at the roller in accordance with the equation for web velocity identified above. In one embodiment, a coefficient of thermal expansion is identified for each roller in a print zone. Thereafter, the controller of the web printing system identifies the temperature for each of the rollers, adjusts the diameter of each roller having a temperature different than the first temperature for the roller using the coefficient of thermal expansion, and then computes the web velocity with the adjusted roller diameters to identify web positions in the print zone for the generation and delivery of firing signals to the printheads for the marking stations.

In operation, a predetermined pattern is generated while a roller is at the first temperature, a second predetermined pattern is generated while the roller is at a second temperature different than the first temperature, and a coefficient of thermal expansion is identified for the roller in the print zone. The process may be repeated for identifying a coefficient of thermal expansion for each roller in a print zone used by the controller implementing either a single reflex or double reflex registration process to compute web velocity at one or more positions in the print zone. Thereafter, the printhead controller obtains signals from temperature sensors mounted proximate the rollers as well as angular velocity signals from rotary encoders mounted proximate the rollers. Adjustments are made to the diameters of the rollers in the print zone with reference to the baseline diameter for each roller, the coefficient of thermal expansion for each roller, and the temperature differential between the current temperature of each roller and its baseline temperature. The modified diameters are used in the computations for determining web velocity and positions within the print zone. Firing signals for the printheads are generated with reference to the computed web velocity and positions. The firing signals are delivered to the printheads to energize the inkjet nozzles in the printheads and eject ink onto the web at positions corresponding to the computed web velocity.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method that compensates for thermally induced diameter changes in a roller of a moving web printing system comprising:

receiving a signal from a first encoder corresponding to an angular velocity of a first roller in a print zone of a moving web printing system;

receiving a signal from a first temperature sensor corresponding to a temperature of the first roller in the print zone of the moving web printing system;

modifying a first diameter stored for the first roller with a first predetermined distance in response to the temperature of the first roller being different than a first predetermined temperature;

identifying a velocity of a moving web in the print zone of the moving web printing system with reference to the modified first diameter; and delivering a firing signal to a first printhead proximate the first roller to energize the inkjet nozzles in the first printhead and eject ink onto the web at a position corresponding to the identified moving web velocity.

2. The method of claim 1 further comprising:

identifying the first predetermined distance with reference to a first coefficient of thermal expansion and a temperature difference between the first predetermined temperature and the temperature corresponding to the signal from the first temperature sensor.

3. The method of claim 1 further comprising:

receiving a signal from a second encoder corresponding to an angular velocity of a second roller in the print zone of the moving web printing system;

receiving a signal from a second temperature sensor corresponding to a temperature of the second roller in the print zone of the moving web printing system;

modifying a first diameter stored for the second roller with a second predetermined distance in response to the temperature of the second roller being different than the predetermined temperature;

identifying a velocity of the moving web in the print zone of the moving web printing system with reference to the modified first diameters for the first and the second rollers; and delivering a firing signal to a second printhead proximate the second roller to energize the inkjet nozzles in the second printhead and eject ink onto the web at a position corresponding to the identified web velocity.

4. The method of claim 3 further comprising:

identifying the second predetermined distance with reference to a second coefficient of thermal expansion and a temperature difference between the second predetermined temperature and the temperature corresponding to the signal from the second temperature sensor.

5. The method of claim 2 wherein the temperature difference is at least a predetermined threshold amount.

6. A system for operating printhead firing in a web printing system comprising:

a first roller configured to rotate with a web moving through a print zone of a web printing system;

a first encoder mounted proximate the first roller to generate a signal corresponding to an angular velocity of the first roller;

a first temperature sensor mounted proximate the first roller to generate a signal corresponding to a temperature of the first roller;

a first printhead positioned in the print zone proximate the web; and a controller coupled to the first encoder, the first temperature sensor, and the first printhead, the controller being configured to identify a distance change in a first diameter of the first roller and to compute a web velocity for the web moving through the print zone with reference to the distance change in the first diameter of the first roller, and the controller also being configured to generate a firing signal to the printhead to eject ink onto the web at a position corresponding to the computed web velocity.

7. The system of claim 6 wherein the distance change in the first diameter of the first roller corresponds to a temperature difference between a first predetermined temperature and a temperature of the first roller corresponding to the signal generated by the first temperature sensor, and a coefficient of thermal expansion for the first roller.

8. The system of claim 6 further comprising:

a second roller configured to rotate with a web moving through a print zone of a web printing system;

a second encoder mounted proximate the second roller to generate a signal corresponding to an angular velocity of the second roller;

a second temperature sensor mounted proximate the second roller to generate a signal corresponding to a temperature of the second roller;

a second printhead positioned in the print zone proximate the web; and the controller being coupled to the second encoder, the second temperature sensor, and the second printhead, the controller being further configured to identify a distance change in a first diameter of the second roller and to compute a web velocity for the web moving through the print zone with reference to the distance change in the first diameter of the second roller, and the controller also being configured to generate a firing signal to the printhead to eject ink onto the web at a position corresponding to the computed web velocity.

9. The system of claim 8 wherein the identification of the distance change for the second roller is made with reference to a coefficient of thermal expansion for the second roller.

10. The system of claim 6 further comprising:

an optical sensor mounted proximate the web at a position outside of the print zone, the optical sensor being configured to generate image data of the web as the web moves past the optical sensor; and the controller is coupled to the optical sensor and further configured to send firing signals to a plurality of printheads in the print zone to eject ink onto the web moving through the print zone to form a predetermined pattern and to identify the coefficients of thermal expansion for the first roller and the second roller from registration errors in the image data of the predetermined pattern on the web generated by the optical sensor.

11. The system of claim 8, wherein the controller is configured to implement a double reflex registration process for computation of the web velocity.

12. The system of claim 8, wherein the controller is configured to implement a single reflex registration process for computation of the web velocity.

13. The system of claim 6 wherein the temperature difference is at least a predetermined threshold amount.

14. A method for computing a thermal coefficient of expansion for a roller in a print zone of a web printing system comprising:

printing a predetermined pattern onto a first portion of a moving web with a first printhead as the web moves through a print zone of a web printing system while a temperature of a first roller in the print zone is at a first temperature;

generating image data corresponding to the printed predetermined pattern after the first portion of the moving web exits the print zone;

printing the predetermined pattern onto a second portion of the moving web with the first printhead as the web moves through the print zone of the web printing system while a temperature of the first roller in the print zone is at a second temperature;

generating image data corresponding to the printed predetermined pattern after the second portion of the moving web exits the print zone; and identifying a coefficient of thermal expansion from a first diameter for the first roller, a displacement between the predetermined pattern on the first portion of the web and the predetermined pattern on the second portion of the web, and a temperature difference between the first temperature and the second temperature.

15. The method of claim 14 wherein the coefficient of thermal expansion is identified by the equation:

$$\frac{d - d_0}{d_0(T - T_0)}$$

where $d_0$ is a diameter of the first roller at the first temperature $T_0$ and $d\text{-}d_0$ is a change in the diameter of the first roller that corresponds to the displacement between the predetermined pattern printed on the first portion of the web and the predetermined pattern printed on the second portion of the web.

16. The method of claim 14 further comprising:

printing a predetermined pattern onto a third portion of the moving web with a second printhead as the web moves through a print zone of a web printing system while a temperature of a second roller in the print zone is at a third temperature;

generating image data corresponding to the printed predetermined pattern after the third portion of the web exits the print zone;

printing the predetermined pattern onto a fourth portion of the moving web as the web moves through the print zone of the web printing system while a temperature of the second roller in the print zone is at a fourth temperature;

generating image data corresponding to the printed predetermined pattern after the fourth portion of the web exits the print zone;

identifying a coefficient of thermal expansion from a first diameter for the second roller, a displacement between the predetermined pattern on the third portion of the web and the predetermined pattern on the fourth portion of the web, and a temperature difference between the third temperature and the fourth temperature.

17. The method of claim 14 wherein the temperature difference is at least a predetermined threshold amount.

* * * * *